US006409098B1

(12) United States Patent
Lewis et al.

(10) Patent No.: US 6,409,098 B1
(45) Date of Patent: Jun. 25, 2002

(54) APPARATUS AND METHOD FOR SPRAYING SINGLE OR MULTI-COMPONENT MATERIAL

(75) Inventors: Russell H. Lewis, Rancho Santa Fe; Mihai A. Solomon, San Diego, both of CA (US)

(73) Assignee: Rhino Linings USA, Inc., San Diego, CA (US)

( * ) Notice: Subject to any disclaimer, the term of this patent is extended or adjusted under 35 U.S.C. 154(b) by 0 days.

(21) Appl. No.: 09/816,451

(22) Filed: Mar. 26, 2001

Related U.S. Application Data

(63) Continuation of application No. 09/451,323, filed on Nov. 30, 1999, now Pat. No. 6,250,567.

(51) Int. Cl.[7] ..... B05B 1/30

(52) U.S. Cl. ..... 239/292; 239/300; 239/419.3; 239/420; 239/424.5

(58) Field of Search ..... 239/290, 292, 239/296, 300, 418, 419.3, 420, 423, 424, 433, 424.5

(56) References Cited

U.S. PATENT DOCUMENTS

| | | | | |
|---|---|---|---|---|
| 4,171,096 A | * | 10/1979 | Welsh et al. | 239/424 X |
| 4,302,550 A | | 11/1981 | Pisaric et al. | |
| 5,102,484 A | * | 4/1992 | Allen et al. | 239/418 X |
| 5,417,372 A | | 5/1995 | Portugal | |
| 5,431,343 A | * | 7/1995 | Kubiak et al. | 239/424 X |
| 5,486,676 A | * | 1/1996 | Aleshin | 239/290 X |
| 5,536,531 A | | 7/1996 | Owen et al. | |
| 5,810,254 A | | 9/1998 | Kropfield | |
| 6,062,492 A | * | 5/2000 | Tudor et al. | 239/296 |
| 6,082,637 A | * | 7/2000 | Ludwig | 239/290 |
| 6,131,823 A | * | 10/2000 | Langeman | 239/423 X |

FOREIGN PATENT DOCUMENTS

| | | |
|---|---|---|
| GB | 730 806 | 6/1955 |
| GB | 972 705 | 10/1964 |

* cited by examiner

*Primary Examiner*—Lesley D. Morris
(74) *Attorney, Agent, or Firm*—Cooley Godward LLP

(57) ABSTRACT

Apparatus and method for delivering single or multi-component material through a disposable delivery tube and atomizing the material into a spray pattern of substantially uniform dispersion. The apparatus includes a tubular manifold having an opening for receiving a disposable delivery tube with the exit end or nozzle of the delivery tube projecting out from the end of the manifold. A plurality of atomizer holes are formed in the end of the manifold surrounding the hole which receives the nozzle end of the delivery tube. A source of air under pressure is connected to direct air through the atomizer holes. An air cap is mounted to the manifold to direct air passing through the atomizer holes about the nozzle of the delivery tube to atomize the delivered material into a uniform spray pattern without the material coming into contact with either the manifold or the air cap.

8 Claims, 4 Drawing Sheets

APPARATUS AND METHOD FOR SPRAYING SINGLE OR MULTI-COMPONENT MATERIAL

This application is a continuation of Application Ser. No. 09/451,323, filed Nov. 30, 1999, now U.S. Pat. No. 6,250,567 the entire content of which is hereby incorporated by reference.

BACKGROUND OF THE INVENTION

1. Field of the Invention

This invention relates generally to the field of single and multi-component spray systems, and specifically to apparatus and methods for delivering a single component or a mixed multi-component material through a disposable delivery tube and atomizing the material into a spray pattern of substantially uniform dispersion where the atomization occurs without any contact between the material and the spray apparatus thereby preventing clogging of the spray apparatus. The invention also covers a method for introducing a single component material or a multi-component material through a disposable delivery tube and applying air pressure to the material as it exits the delivery tube to atomize the material into a spray pattern of substantially uniform dispersion.

2. Description of Related Art

Multi-component materials usually consist of two or more components. These components are shipped and stored separately until the time of application. Then the components must be mixed together at their specified proportion ratio. Once properly mixed, the material can be applied using conventional methods such as air spray, airless spray, dispensing or extrusion, or metering. Typically, multi-component material consist of a base material and a catalyst, or a resin and a hardener, and once mixed, these materials usually cure rapidly. Usually, it is important that the two or more materials be well mixed together in a specific proportion which is referred as a mix ratio.

In conventional systems, because the mixed material passes through the internal passageways in the spray apparatus when the spraying stops, the mixed material quickly cures within the internal passageways causing clogging. This necessitates that the user must remove the spray tip and clean the atomizer passageways and outlets or flush it with a cleaning solvent which generates potential disposal problems. In addition, in the prior art spraying apparatus and processes for spraying a single component material, the material passes through the internal passageways of the spray apparatus before it is atomized, thereby leaving the nozzle subject to clogging when the spraying is stopped.

SUMMARY OF THE INVENTION

This invention relates to an apparatus and methods for spraying a single component material or a multi-component material in a manner such that there is no physical contact between the material and the internal passageways of the spray assembly. The apparatus of this invention includes a tubular manifold having a first longitudinal opening partially therethrough of a first diameter for receiving a portion of a disposable material delivery tube having an inlet end of a first diameter and a stepped exit end of a plurality of decreasing diameters. The manifold has a smaller second longitudinal opening therein formed coaxially with the first longitudinal opening for receiving in a close fitting relationship one of the smaller stepped ends of a delivery tube so that the distal end or tip of the delivery tube projects a predetermined distance from the end of the manifold. A plurality of atomizer holes are formed in the distal end of the tubular manifold symmetrically about the second longitudinal opening. The manifold has an air passageway therethrough for connecting to a source of pressurized air.

An adjustable air cap is mounted to the distal end of said manifold for directing air passing through the atomizer holes toward the exit end of the delivery tube at a desired spray angle to atomize the material into a substantially uniform conical pattern for spraying onto a surface. The air cap is designed so that the tip of the delivery tube is substantially flush with the end of the air cap. The manifold guides and positions the delivery tube so that the tip is concentrically mounted within the air cap allowing air to uniformly flow past the tip. When the spraying of the material is concluded, the spray apparatus does not become clogged due to the fact that the sprayed material is not in contact with any internal passageways in the spray assembly. If the sprayed material sets, the disposable delivery tube can be discarded and a new one inserted for another spraying operation. Due to the elimination of the necessity to clean the spray nozzle after each material application, the need for cleaning solvents is eliminated. This makes the subject apparatus and method environmentally friendly.

The methods of this invention include introducing a material under pressure into an inlet end of a delivery tube and out through an outlet end or tip of the delivery tube. A symmetrical pattern of air under pressure is introduced into the material as it exits from the tip of the delivery tube. The air is introduced at a predetermined distance back from the tip of the delivery tube. The spray angle of the pressurized air is adjustable to atomize the material into a conical spray pattern of substantially uniform dispersion.

The subject invention is applicable to spraying any kind of material, but particularly those that are rapid curing and/or are difficult to clean upon drying or setting. The materials that can be sprayed in accordance with the principles of this invention include, without limitation, paint, glue, stucco, mastics, adhesives, sealants, foams, undercoating and other coatings.

It is the primary object of the present invention to provide a spray apparatus wherein the cleanup of the spray assembly is eliminated by using a disposable internal delivery tube and not having any spray assembly passageways to clean.

Another object of the present invention is to provide a more precisely controlled spray pattern providing a more uniform application.

Another object of the present invention is to provide improved transfer efficiency.

Further aspects of the present invention will become apparent from the following detailed description when considered in conjunction with the accompanying drawings. It should be understood, however, that the detailed description and the specific examples while representing the preferred embodiments are given by way of illustration only.

BRIEF DESCRIPTION OF THE DRAWINGS

FIG. 2 is an exploded view of a material delivery tube and spray nozzle assembly including a tubular manifold and atomizer air cap in accordance with the principles of this invention.

DETAILED DESCRIPTION OF THE PREFERRED EMBODIMENTS

The following description is of the best presently contemplated modes of carrying out the subject invention. This description is made for the purpose of illustrating the general principles of the invention and should not be taken in a limited sense.

Figure 1:
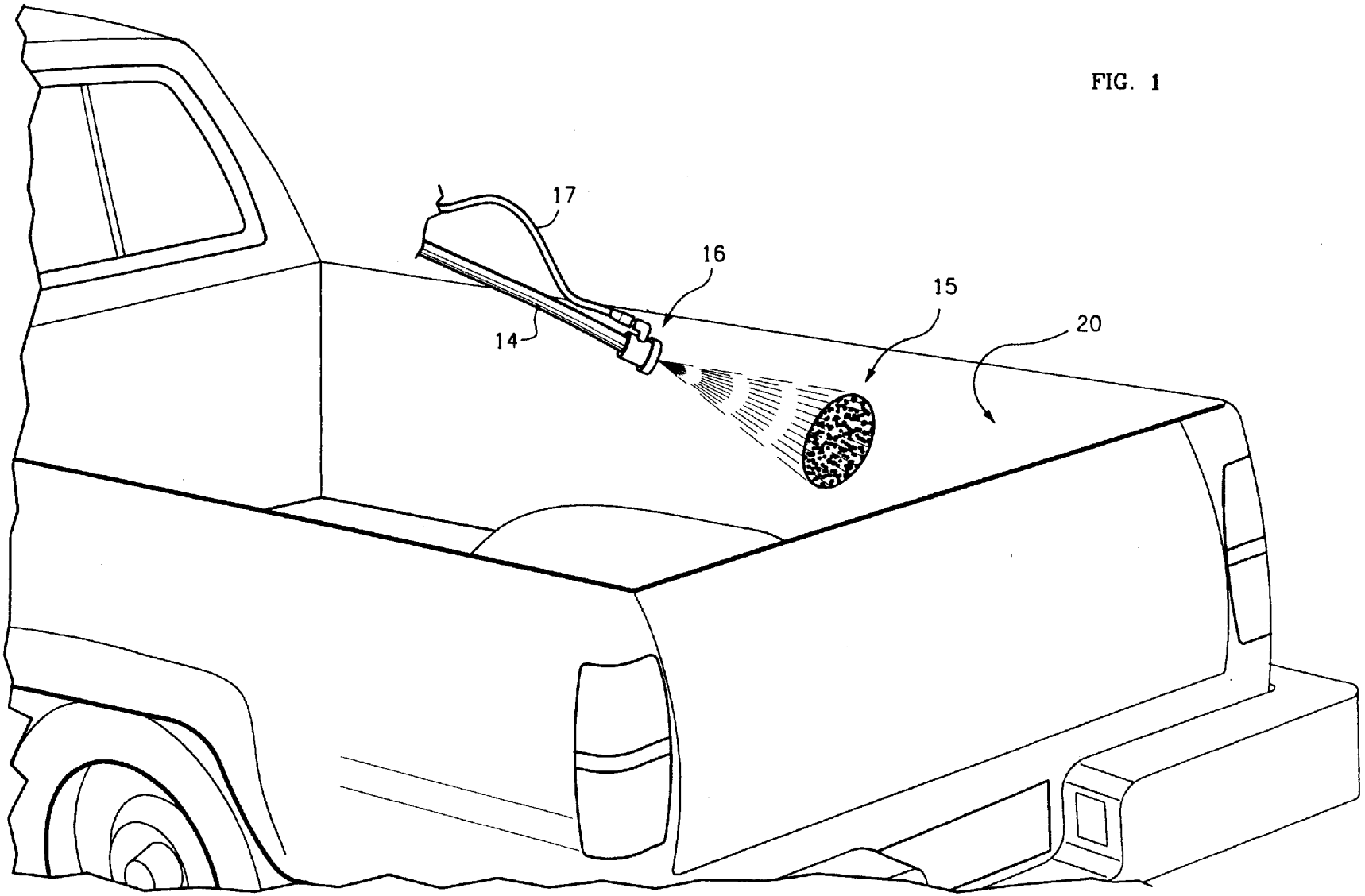
FIG. 1 is an overall view of a portion of spray apparatus illustrating the metering and mixing of two chemical components which are sprayed in accordance with the principles of this invention.

Referring to FIG. 1 there is shown a two chemical component spray system of the type typically used to spray a multi-component material such as polyurethane. This system introduces the resin and the hardener into a delivery or static mixing tube 14 having flights or elements therein which mix a plurality of chemical components under pressure. The exit end of the static mixing tube 14 passes through a spray assembly 16 described more fully hereinafter. An air line 17 provides air into the spray assembly 16 to atomize the mixed chemical components to form a uniform spray pattern 15. The spray system is shown applying a polyurethane liner to a truck bed 20. When a polyurethane elastomer is being sprayed, it becomes a solid in seconds after it leaves the spray assembly 16. The delivery tube is disposable. Thus a new tube 14 can be inserted with minimal downtime and no cleanup of the spray assembly 16.

Figures 3, 4:
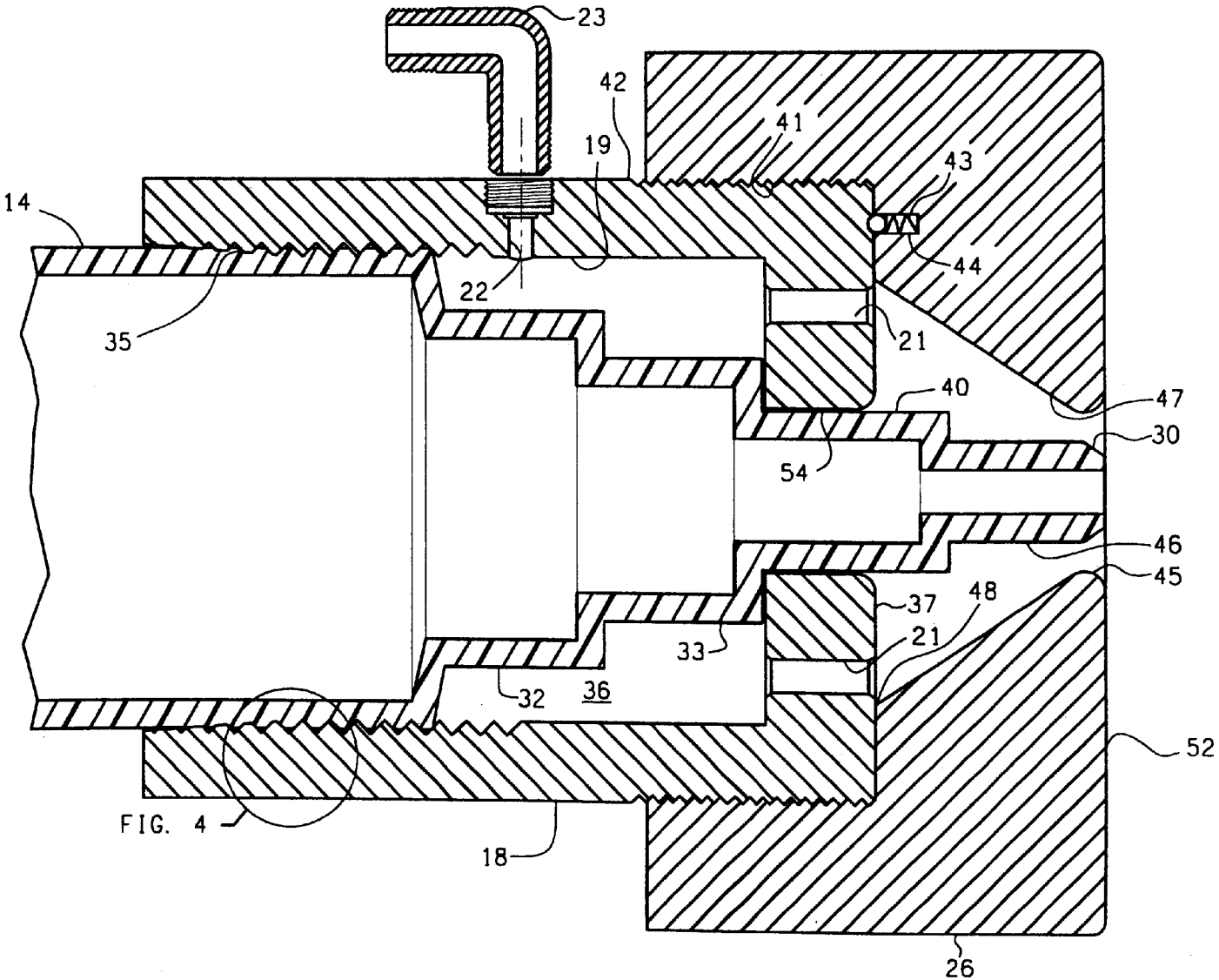
FIG. 3 is a cross-sectional view taken along line 3—3 of FIG. 1 illustrating the inside of the tubular manifold and air cap of the subject invention.

Referring to FIG. 2 there is shown an exploded view of the spray assembly 16 and the static mixer 14 and air line 17. The spray assembly 16 includes a tubular air manifold 18 having an internal longitudinal passageway 19 formed therein (FIG. 3). The diameter of the internal passageway 19 is partially threaded so that the outer diameter of the static mixer 14 can be threaded into the manifold forming an air tight fit. A plurality of holes 21 are symmetrically formed in the end of the tubular manifold 18 to provide air under pressure which is uniformly dispersed to atomize the mixed multi-component materials. An air inlet 22 is provided in the tubular manifold 18. The size and positioning of the air inlet is critical as described hereinafter for optimum atomization and uniform dispersion. An elbow 23 has one end connected to the air inlet 22 and the other end connected through a coupler assembly 24 to a fitting 15 of an air line 17. An atomizer air cap 26 is threaded onto the end of the manifold 18 to provide precise control of the spray pattern.

Referring to FIG. 3, there is shown a cross-sectional view of the air manifold 18 and the air cap 26. The static mixer or delivery tube 14 has a stepped end with a plurality of steps which decrease in diameter down toward the outlet 30. In FIG. 3, there are four steps 32, 33, 40 and 46 shown from the main diameter down toward the exit end 30. The manifold 18 has a first longitudinal passageway 19 which is internally threaded at the inlet end 35 to engage the static mixing tube 14. The first step 32 and second step 33 of the delivery tube 14 are each smaller in diameter than the diameter of the passageway 19 to provide an annular air chamber 36 through which air flows from the air inlet 22 which is connected to a source of pressurized air. The geometry of steps 32 and 33 of delivery tube 14 is used to create the desired air accumulation chamber 36 which helps maintain constant air pressure and volume at the ideal level. If desired, a delivery tube or static mixer tube may not be stepped but the manifold has to be designed to have the desired size and shape to provide the required air chamber to give the proper distribution of air therethrough. The end 37 of the manifold 18 has a plurality of holes 21 symmetrically formed about the opening 54 in the manifold 18. The holes 21 communicate with the annular air chamber 36 so that air passing through the air inlet 22 into the annular chamber 36 is directed outwardly through holes 21, where it is directed by the cap 26 at a prescribed angle toward the exit end 30 of the static mixer 14. The size and positioning of the air inlet 22 is important. The ratio of the surface area of the air inlet hole 22 to the combined areas of the outlet holes 21 is predetermined for optimum performance. It has been found that a ratio of approximately 1:4 is the optimum for spraying polyurethane. Other materials may require a different ratio which has to be determined empirically.

The spray assembly 16 is designed so that when the flow of material is stopped there are no materials left within any of the spaces of the spray assembly. The air cap is designed so that the exit end 30 of the delivery tube is substantially flush with the end of the air cap 26 for optimum performance. However, the design can be modified so that tip 30 slightly projects or is slightly recessed from the end of the air cap in order to alter the spray pattern. The atomizer air cap is threaded internally at 41 to engage the complimentary threads 42 formed on the exterior of the manifold 18. The atomizer air cap 26 has a spring loaded ball assembly 43 inserted into an opening 44 which bears against the end face of the manifold 18 which has a slight depression 50 (shown in FIG. 2) therein. This serves to hold the air cap 26 in the precise position to which it is rotated for maintaining the desired spray angle thereby assuring stability of the spraying geometry. If desired, by rotating the atomizer air cap, 26, the spray angle can be changed. The spray pattern can also be changed by adjusting the air pressure.

Figure 4:
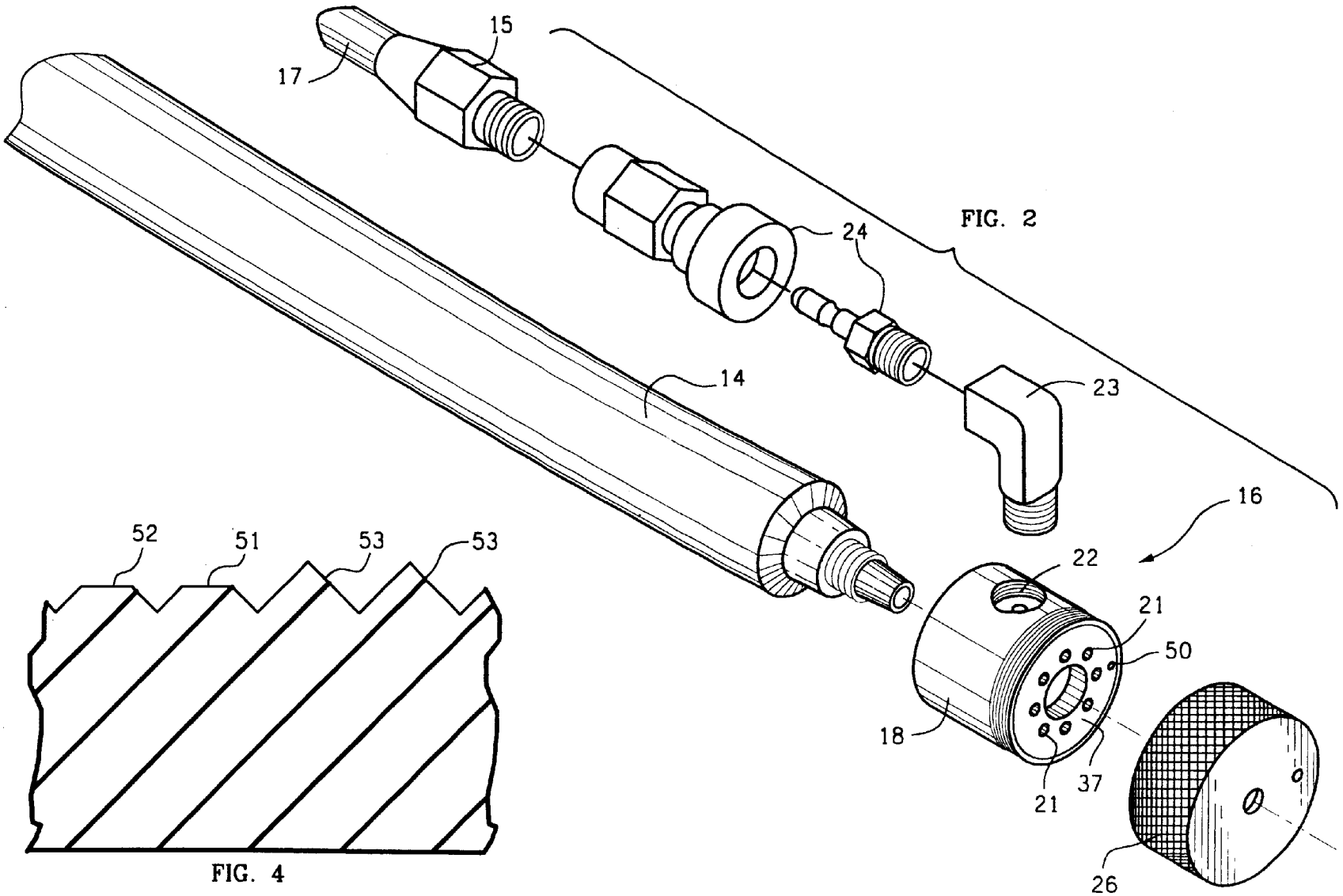
FIG. 4 is a cross-sectional view of a portion of the tubular manifold illustrating the combination of threads used to guide and secure the delivery tube to the manifold.

Referring to FIG. 4, there is shown an enlarged view of the inlet end of the atomizer manifold 18. A plurality of trapezoidal guide threads 51 are used to guide the delivery tube 14 coaxially into position within the manifold 18. The flats 52 of the threads 51 are formed to close tolerance to hold the outer diameter of the delivery tube so that the tip 30 is precisely centered within the hole 45 in the air cap as shown in FIG. 3. The guide threads 51 guide the tube 14 as it is inserted into the manifold 18 to center the tube properly. A plurality of sharp threads 53, which are cutting threads, cut into the tube to form close fitting relationship between the manifold and the tube with the tip 30 being centered within the opening 45 in the air cap 26. This unique arrangement of threads in the manifold 18 insures the precise positioning of the exit end 30 of the delivery tube within the center of the hole 45 in the air cap 26.

Figure 5:
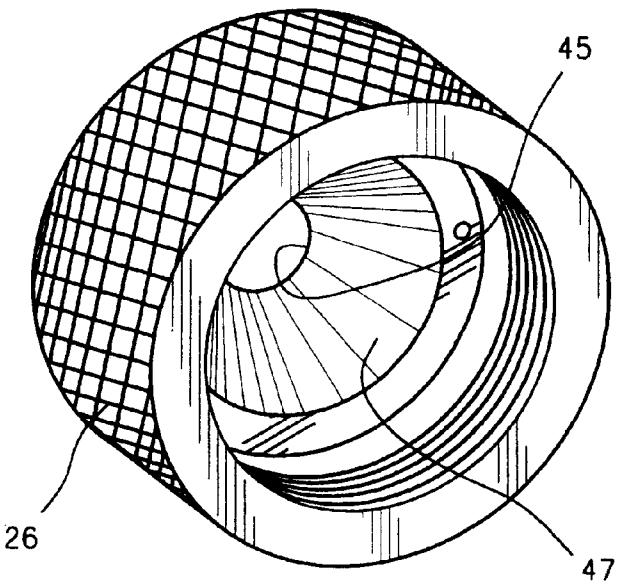
FIG. 5 is a perspective view of the air cap of the present invention.

Referring again to FIG. 3 and FIG. 5, the air cap 26 has an opening 45 which is rounded and which is precisely dimensioned to be spaced a predetermined distance away from the outer diameter of the fourth step 46 of the static mixer 14. A conical surface 47 is formed on the inside of the air cap 26. As the cap 26 is rotated, the spray angle will change thereby determining the pattern which is sprayed.

The spacing between the opening 45 in the air cap 26 and the end 46 of the static mixer tube, in conjunction with the displacement between the end 30 of the static mixer 14 and the end surface 52 of the air cap 26, controls air velocity and volume and provides the ideal spray pattern. The outside diameter 48 of the conical portion 47 of the air cap 26 is slightly larger than the outer diameter of the pattern of symmetrical holes 21 so as not to block the flow of air. The diameter of the opening 45 is selected to provide the optimum predetermined spacing between the tip 30 of the delivery tube 14 and the air cap 26.

When the spray gun stops dispensing the mixed material, no material is left in any of the passageways in the spray assembly 16. The only material left is in the static mixer tube 14. Thus, when a new operation is started, the static mixer tube 14 may be replaced and no further cleaning of the spray assembly 16 is necessary. This saves a considerable amount of time in any kind of spraying operation.

Figure 6:
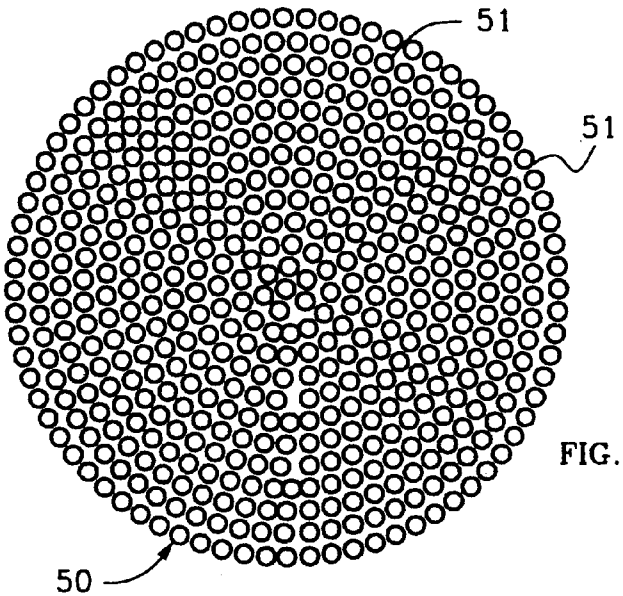
FIG. 6 is a representation of the circular spray pattern illustrating the symmetrical shape and substantially uniform size and shape of the spray droplets achieved in accordance with the present invention.

Referring to FIG. 6, there is shown a spray pattern generally designated as 50. The pattern shows a plurality of substantially uniform droplets 51 which are all substantially circular and symmetrically positioned within the circular spray pattern provided by the subject invention. This spray pattern allows the operator to provide a more uniform application. It also results in less over spray or waste material and improve ease of application.

Figure 7:
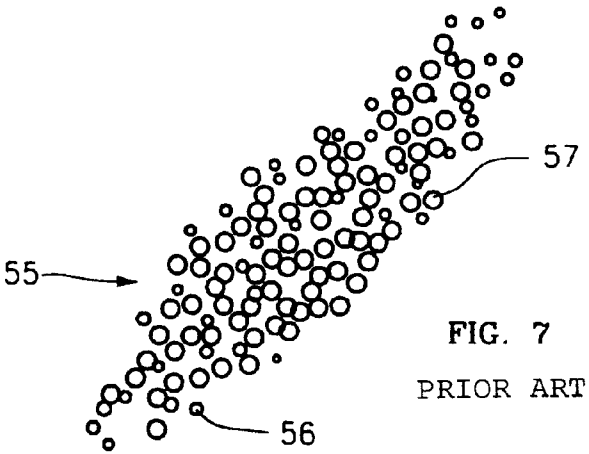
FIG. 7 PRIOR ART
FIG. 7 is a representation of the pattern of prior art spray apparatus showing the irregular, somewhat elliptical cross-section of the spray pattern and the non-symmetrical droplet size achieved by conventional methods and apparatus.

Referring to FIG. 7, there is shown a conventional prior art pattern generally designated as 55 which is irregular in shape forming somewhat of an ellipse and having non-symmetrical droplets of different sizes 56 and 57.

In use, once the application, of polyurethane or other multi-component material is started, the air atomizer cap 26 is rotated to achieve the desired spray angle. This rotation once set will be maintained by the spring loaded ball assembly 43. When the application of the polyurethane to a truck bed or any other surface is completed, the spray gun trigger is released stopping the flow of air and the mixed material. Due to the quick curing times of the polyurethane, any mixed material within the static mixing tube becomes solid relatively quickly. However, because none of the mixed material is in any of the other passageways of the spray nozzle, the nozzle does not become clogged and it does not have to be cleaned or flushed with a cleaning solvent. Due to the elimination of the need to clean the spray assembly after each material application, it likewise eliminates the need for cleaning solvents used in the cleaning process thereby making the apparatus more environmentally friendly. The use of the subject invention also improves transfer efficiency resulting in less overspray and reduced air flow, again reducing waste and improving ease of application. Transfer efficiency has two components; the first is how much overspray you have, and the second is how much air do you need to atomize the material. Greater transfer efficiency requires a smaller size air compressor. Further, greater transfer efficiency results in more sprayed material going onto the work surface and less material being wasted. The subject invention requires less air flow in cubic feet per minute than prior art assemblies because of the transfer efficiency of the design of the subject invention.

The unique design of the atomizer manifold 18 and the atomizer spray cap 26 allows precise control over the sprayed material. The precision alignment between the static mixer tube 14 and the manifold 18 which typically are ±0.0015 inches provides very precise alignment of the end 30 of the static mixer 14 relative to the atomizer air cap 26. This precise control between the static mixer tube and the air cap 26 helps determine the atomization and spray pattern.

While the invention has been described with respect to spraying a multi-component material, it is also applicable to spraying a single material with or without mixing. Although the present invention has been described in terms of certain preferred embodiments and exemplified with respect thereto, one skilled in the art will readily appreciate that various modifications, changes, omissions and substitutions may be made without departing from the spirit and scope thereof.

It is intended that the present invention be limited solely by the scope of the following claims:

1. A disposable spray tube for transporting a viscous material to a manifold having an interior surface and an exterior surface, the spray tube comprising:

a receptor end for receiving the viscous material;

a discharge end for discharging the viscous material; and a body element disposed between the receptor end and the discharge end, the body element comprising:

a first portion with a first outer diameter;

a second portion connected with the first portion, the second portion having a second diameter, wherein the second diameter is smaller than the first diameter;

a third portion connected with the second portion, the third portion having a third diameter, wherein the third diameter is smaller than the first diameter;

wherein the first portion of the body element is configured to engage with an interior surface of the manifold and wherein the second portion of the body element is configured to be disengaged from the interior surface of the manifold when the first portion of the body element is engaged with the interior surface of the body element such that an air chamber is formed between the second portion of the body element and the interior surface of the manifold and;

wherein the third portion is configured to be disengaged from the interior surface of the manifold when the first portion of the body element is engaged with the interior surface of the body element such that an air chamber is formed between the third portion of the body element and the interior surface of the manifold; and wherein the receptor end, the discharge end, and the body element comprise a single, non-jointed, disposable spray tube.

2. The spray tube of claim 1, wherein the discharge end of the body element is directly connected to the third portion of the body element.

3. The spray tube of claim 1, wherein the second portion of the body element is directly connected to the first portion of the body element.

4. The spray tube of claim 1, wherein the discharge end of the body element is directly connected to the second portion of the body element.

5. In a system comprising a manifold having an interior surface, an exterior surface, an input end and a discharge end, wherein the discharge end comprises a substantially planar surface including a plurality of discharge outlets and a port, a spray tube comprising:

a receptor end for receiving the viscous material;

a discharge end for discharging the viscous material; and a disposable body element disposed between the receptor end and the discharge end, the body element comprising:

a first portion with a first outer diameter;

a second portion connected with the first portion, the second portion having a second diameter, wherein the second diameter is smaller than the first diameter; and a third portion connected with the second portion, the third portion having a third diameter, wherein the third diameter is smaller than the first diameter;

wherein the first portion of the body element is configured to engage with the interior surface of the manifold and wherein the second portion of the body element is configured to be disengaged from the interior surface of the manifold when the first portion of the body element is engaged with the interior surface of the body element such that an air chamber is formed between the second portion of the body element and the interior surface of the manifold; and wherein the third portion is configured to be disengaged from the interior surface of the manifold when the first portion of the body element is engaged with the interior surface of the body element such that an air chamber is formed between the third portion of the body element and the interior surface of the manifold.

6. The spray tube of claim 5, wherein the discharge end of the body element is directly connected to the third portion of the body element.

7. The spray tube of claim 5, wherein the second portion of the body element is directly connected to the first portion of the body element.

8. The spray tube of claim 5, wherein the discharge end of the body element is directly connected to the second portion of the body element.

* * * * *